US010031459B2

(12) United States Patent
Ino et al.

(10) Patent No.: US 10,031,459 B2
(45) Date of Patent: Jul. 24, 2018

(54) IMAGE FORMING APPARATUS FOR CORRECTING COLOR MISREGISTRATION

(71) Applicant: CANON KABUSHIKI KAISHA, Tokyo (JP)

(72) Inventors: Koichiro Ino, Tokyo (JP); Ryuichi Araki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/420,543

(22) Filed: Jan. 31, 2017

(65) Prior Publication Data

US 2017/0235266 A1 Aug. 17, 2017

(30) Foreign Application Priority Data

Feb. 16, 2016 (JP) ..... 2016-026733

(51) Int. Cl.
*G03G 15/00* (2006.01)
*G03G 15/01* (2006.01)

(52) U.S. Cl.
CPC ..... *G03G 15/5058* (2013.01); *G03G 15/0131* (2013.01); *G03G 15/0189* (2013.01); *G03G 2215/0129* (2013.01); *G03G 2215/0158* (2013.01); *G03G 2215/0161* (2013.01)

(58) Field of Classification Search
CPC ..... G03G 15/5058; G03G 15/0131; G03G 15/0189; G03G 2215/0129; G03G 2215/0158; G03G 2215/0161
USPC ..... 399/301
See application file for complete search history.

(56) References Cited

U.S. PATENT DOCUMENTS 7,689,151 B2 * 3/2010 Katsuhara ..... G03G 15/5058 399/301
8,744,325 B2 6/2014 Ino et al.
2009/0080915 A1 * 3/2009 Hashimoto ..... G03G 15/0131 399/39
2013/0287457 A1 * 10/2013 Sato ..... G03G 15/0189 399/301

FOREIGN PATENT DOCUMENTS

JP 2007-148080 A 6/2007

* cited by examiner

*Primary Examiner* — Sophia S Chen
(74) *Attorney, Agent, or Firm* — Fitzpatrick, Cella, Harper, Scinto

(57) ABSTRACT

An image forming apparatus includes a plurality of image forming units, an intermediate transfer member, a detection unit, and a controller. The controller is configured to control the plurality of image forming units to form, on the intermediate transfer member, a pattern image including a first detection image having a reference color among the plurality of detection images and a second detection image having another color among the plurality of detection images. The first detection image and the second detection image are superimposed on a predetermined detection image. The controller is configured to control the detection unit to detect the amount of color misregistration which is related to a relative position of the first detection image and the second detection image, and to determine an adjustment value for adjusting an image write start timing of the other color different from the reference color.

15 Claims, 12 Drawing Sheets

IMAGE FORMING APPARATUS FOR CORRECTING COLOR MISREGISTRATION

BACKGROUND OF THE INVENTION

Field of the Invention

The present invention relates to an electrophotographic image forming apparatus, such as a copying machine or a printer.

Description of the Related Art

An image forming apparatus is configured to, for example, form toner images having different colors on a plurality of photosensitive members and superimpose those toner images on one another for transfer onto a recording medium, e.g., a sheet, to thereby form a color image. The image forming apparatus may be configured to directly transfer toner images from a plurality of photosensitive members onto a recording medium, or may be configured to perform a primary transfer from photosensitive members onto an intermediate transfer member and then perform a secondary transfer from the intermediate transfer member onto a recording medium.

This type of image forming apparatus is configured such that toner images formed on a respective plurality of photosensitive members are superimposed on one another precisely on a recording medium. However, there may occur so-called color misregistration in which the toner images are not superimposed on one another on the recording medium due to influences of, for example, tolerance of parts of the image forming apparatus and position variations of parts due to a temperature change at the time of image formation. To address this problem, the image forming apparatus performs control for correcting the color misregistration.

As the color misregistration correction control, for example, a pattern image including measurement images for detecting color misregistration of respective colors is formed on an image bearing member, e.g., an intermediate transfer member, to detect formation positions of the measurement images of respective colors. The image forming apparatus calculates amounts of color misregistration based on relative positions of the measurement images of respective colors, and corrects color misregistration by adjusting formation positions of toner images on respective photosensitive members so that those amounts of color misregistration are reduced.

The pattern image for color misregistration detection is detected by an optical sensor. The optical sensor includes a light emitting unit and a light receiving unit. When the pattern image for color misregistration detection, which is formed on the image bearing member, is detected, the optical sensor emits light from the light emitting unit toward the image bearing member and the pattern image on the image bearing member. The light receiving unit receives the reflected light. The light receiving unit outputs an analog signal in accordance with the light amount (reflected light amount) of the received reflected light. The light receiving unit outputs analog signals having different detection values (output values) for the amount of light reflected by the image bearing member and the amount of light reflected by the pattern image. The image forming apparatus converts the analog signals output from the light receiving unit into digital signals based on a predetermined threshold value. The image forming apparatus detects the relative positions of the measurement images for detecting color misregistration of respective colors on the image bearing member based on, for example, a pulse center of gravity of the converted digital signals and timings of rising and falling of pulses.

When the intermediate transfer member has a low reflectance, the optical sensor has difficulty in detecting an achromatic toner image, e.g., a black toner image having a low reflectance. In view of this, there is proposed a technology of forming a chromatic toner image having a high reflectance on the intermediate transfer member as a base and then forming thereon a measurement image for color misregistration detection with a black toner image to facilitate detection of a black measurement image (U.S. Pat. No. 8,744,325).

Further, the surface state of the intermediate transfer member changes due to a manufacture variation or a variation over time. The change of the surface state of the intermediate transfer member results in a change in reflection state. The change of the surface state of the intermediate transfer member causes the threshold value for converting an analog signal, which is dependent on the amount of reflected light, into a digital signal to be an inappropriate value. Because of this, it becomes difficult to detect the position of the pattern image for color misregistration detection accurately. For example, in a case where the reflection state of the intermediate transfer member changes and the amount of reflected light increases to cause an analog signal to exceed the threshold value, the position of the pattern image for color misregistration detection cannot be detected accurately. To counter this problem, there is proposed a technology of setting the threshold value for converting an analog signal into a digital signal based on the amount of light reflected by the intermediate transfer member (Japanese Patent Application Laid-open No. 2007-148080). The threshold value is set based on the amount of reflected light, and thus it is possible to set an appropriate threshold value.

SUMMARY OF THE INVENTION

An image forming apparatus according to the present disclosure includes: a plurality of image forming units configured to form images, each having a different color; an intermediate transfer member onto which the images formed by the plurality of image forming units are transferred; a detection unit configured to detect a detection image formed on the intermediate transfer member, the detection image being used for detecting color misregistration; and a controller configured to: control the plurality of image forming units to form, on the intermediate transfer member, a pattern image including a plurality of detection images, each having a different color, control the detection unit to detect an amount of color misregistration associated with a relative position of a first detection image having a reference color among the plurality of detection images and a second detection image having another color among the plurality of detection images, and to determine an adjustment value for adjusting an image write start timing of the another color different from the reference color based on the amount of color misregistration detected by the detection unit, wherein the pattern image includes the first detection image, the second detection image, and a predetermined detection image, wherein the first detection image and the second detection image are superimposed on the predetermined detection image.

Further features of the present invention will become apparent from the following description of exemplary embodiments (with reference to the attached drawings).

DESCRIPTION OF THE EMBODIMENTS

In the following, a description is given in detail of an embodiment of the present invention with reference to the drawings.

Configuration

Figure 1:
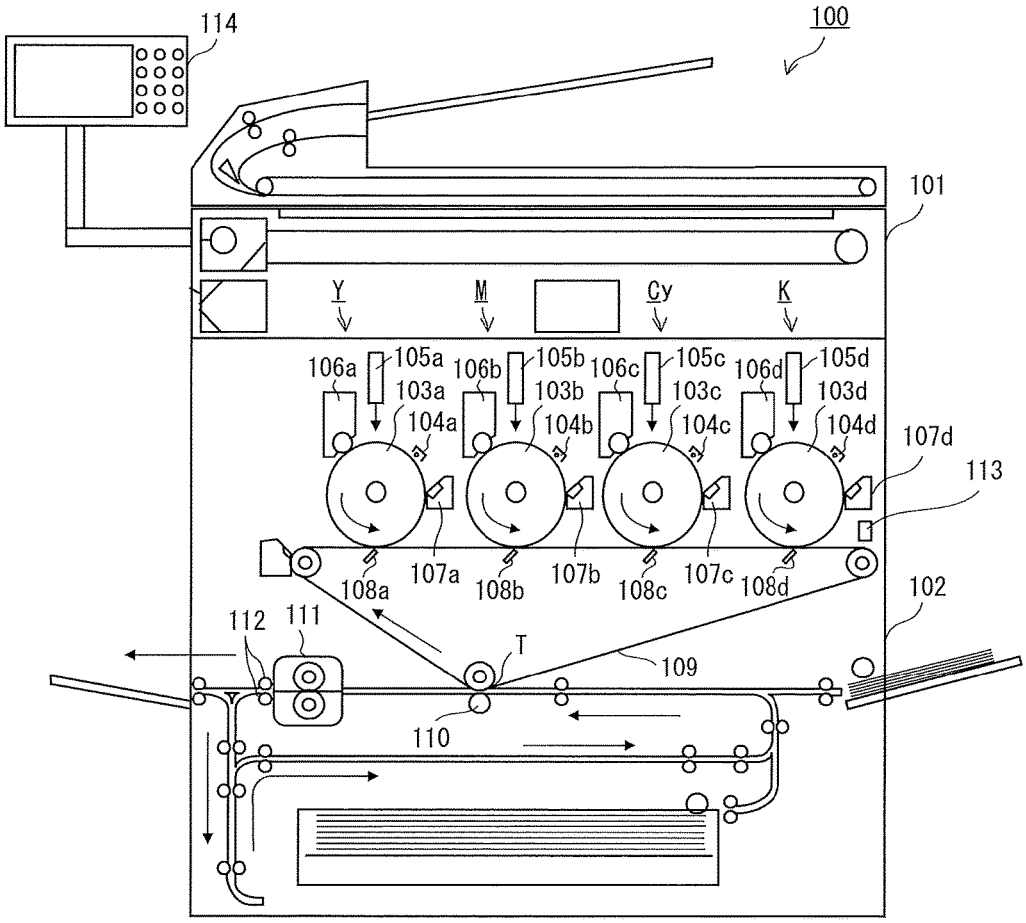
FIG. 1 is a configuration diagram of an image forming apparatus.

FIG. 1 is a configuration diagram of an image forming apparatus 100 according to this embodiment. The image forming apparatus 100 is an electrophotographic full-color printer. The image forming apparatus 100 includes an original reading unit 101, an image forming unit 102, and an operation unit 114. The original reading unit 101 is, for example, a scanner, and is configured to generate an image signal based on an original image read from an original. The image forming unit 102 is configured to generate an image on a recording medium, e.g., a sheet, based on the image signal generated by the original reading unit 101.

The image forming unit 102 includes image forming stations Y, M, Cy, and K for forming toner images of respective colors, namely, yellow (Y), magenta (M), cyan Cy, and black (K). The respective image forming stations Y, M, Cy, and K have the same configuration, and are different from one another only in that those image forming stations form toner images of different colors.

The image forming station Y is a drum-shaped photosensitive member, and includes a photosensitive drum 103*a* serving as an image bearing member configured to bear a yellow toner image. A charging device 104*a*, an exposing device 105*a*, a developing device 106*a*, and a cleaner 107*a* are arranged around the photosensitive drum 103*a*. The charging device 104*a* is configured to charge the surface of the photosensitive drum 103*a*. The exposing device 105*a* is configured to scan the photosensitive drum 103*a* with laser light that is modulated based on a yellow image signal to form an electrostatic latent image on the photosensitive drum 103*a*. The developing device 106*a* is configured to develop the electrostatic latent image with a yellow toner to form a yellow toner image on the photosensitive drum 103*a*. The cleaner 107*a* is configured to clean toner remaining on the photosensitive drum 103*a* after transferring the toner image onto an intermediate transfer belt 109 described later.

The image forming station M includes a photosensitive drum 103*b*, a charging device 104*b*, an exposing device 105*b*, a developing device 106*b*, and a cleaner 107*b*. The image forming station M is configured to form a magenta toner image on the photosensitive drum 103*b*. The image forming station Cy includes a photosensitive drum 103*c*, a charging device 104*c*, an exposing device 105*c*, a developing device 106*c*, and a cleaner 107*c*. The image forming station Cy is configured to form a cyan toner image on the photosensitive drum 103*c*. The image forming station K includes a photosensitive drum 103*d*, a charging device 104*d*, an exposing device 105*d*, a developing device 106*d*, and a cleaner 107*d*. The image forming station K is configured to form a black toner image on the photosensitive drum 103*d*.

The intermediate transfer belt 109, which serves as both an intermediate transfer member and an image bearing member configured to bear a full-color toner image after toner images of respective colors formed on the photosensitive drums 103*a* to 103*d* are transferred thereon, is provided under the image forming stations Y, M, Cy, and K. Transfer blades 108*a* to 108*d*, which serve as primary transfer members, are arranged opposite to the photosensitive drums 103*a* to 103*d*, respectively, across the intermediate transfer belt 109.

The yellow toner image formed on the photosensitive drum 103*a* is transferred onto the intermediate transfer belt 109 by a transfer bias applied to the transfer blade 108*a*. The magenta toner image formed on the photosensitive drum 103*b* is transferred onto the intermediate transfer belt 109 by a transfer bias applied to the transfer blade 108*b*. The cyan toner image formed on the photosensitive drum 103*c* is transferred onto the intermediate transfer belt 109 by a transfer bias applied to the transfer blade 108*c*. The black toner image formed on the photosensitive drum 103*d* is transferred onto the intermediate transfer belt 109 by a transfer bias applied to the transfer blade 108*d*. As a result, toner images of respective colors are formed on the intermediate transfer belt 109.

The intermediate transfer belt 109 is configured to forma secondary transfer portion T between the intermediate transfer belt 109 and a secondary transfer roller 110. The intermediate transfer belt 109 rotates in the clockwise direction in FIG. 1, to thereby convey the toner images transferred from the respective photosensitive drums 103*a* to 103*d* to the secondary transfer portion T. A recording medium is conveyed to the secondary transfer portion T in synchronization with the timing at which the toner image is conveyed. The recording medium is conveyed between the intermediate transfer belt 109 and the secondary transfer roller 110, and the toner images of respective colors are collectively transferred from the intermediate transfer belt 109 onto the recording medium.

A fixing device 111 is provided on a downstream side in the conveying direction of the recording medium. The fixing device 111 is configured to fix a toner image on the recording medium onto which the toner image is transferred. For example, the fixing device 111 heats and pressurizes the recording medium to fix the toner image on the recording medium. The recording medium having the toner image fixed thereon is discharged from the fixing device 111 to the outside of the image forming apparatus 100 by discharge rollers 112 or the like.

The image forming station K for forming a black toner image is provided nearer to the secondary transfer portion T in the rotation direction of the intermediate transfer belt 109 than the other image forming stations Y, M and Cy. With such an arrangement, when a monochrome image is formed, a period of time from an image formation instruction to discharge of the recording medium on which the image is formed is suppressed.

An optical sensor 113 is provided nearer to the secondary transfer portion T than the image forming station K in the rotation direction of the intermediate transfer belt 109. The optical sensor 113 is configured to detect a pattern image, which is a toner image for color misregistration detection formed on the intermediate transfer belt 109.

An operation unit 114 is an input/output device including a display and a key button. The display is provided with a touch pad to function as a touch panel. The operation unit 114 is configured to input an image formation start instruction to the image forming apparatus 100 by a user operating the touch panel or the key button, and to input settings of various functions.

Figure 2:
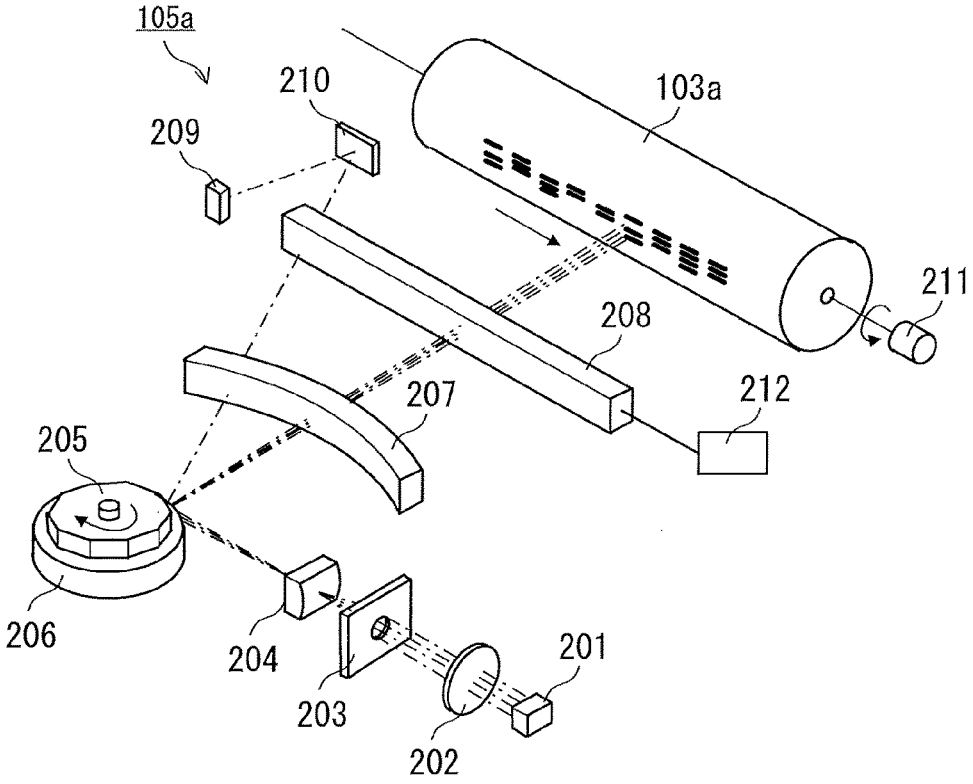
FIG. 2 is an explanatory diagram of an exposing device.

FIG. 2 is an explanatory diagram of the exposing device 105*a*. The exposing device 105*a* and the exposing devices 105*b*, 105*c*, and 105*d* have the same configuration. Now, the exposing device 105*a* is described, and the description of the exposing devices 105*b*, 105*c*, and 105*d* is omitted here.

The exposing device 105*a* includes a semiconductor laser 201 serving as a light source, a collimator lens 202, an aperture stop 203, a cylindrical lens 204, a rotary polygon mirror 205, a rotary polygon mirror driving unit 206, a toric lens 207, and a diffractive optical element 208. Further, the exposing device 105*a* includes a reflection mirror 210 and a beam detector 209 in order to control the timing to start scanning of the photosensitive drum 103*a* by laser light.

The collimator lens 202 is configured to convert laser light emitted from the semiconductor laser 201 into a parallel light flux. The aperture stop 203 is configured to limit the light flux of the passing laser light. The cylindrical lens 204 has a predetermined refractive power only in a sub scanning direction, and is configured to form an image of the light flux having passed through the aperture stop 203 as an elliptical image elongated in a main scanning direction on the reflecting surface of the rotary polygon mirror 205. The rotary polygon mirror 205 is rotated at a constant speed in the clockwise direction in FIG. 2 by the rotary polygon mirror driving unit 206, and deflects and scans the laser light imaged on the reflecting surface. The toric lens 207 is an optical element having an fθ characteristic, and has different refractive indices in the main scanning direction and the sub-scanning direction. Both front and rear lens surfaces in the main scanning direction of the toric lens 207 are aspheric. The diffractive optical element 208 is an optical element having an fθ characteristic, and has different magnifications in the main scanning direction and the sub-scanning direction.

The beam detector 209 is provided at a position outside of an image forming region of the photosensitive drum 103*a*. The beam detector 209 detects laser light reflected by the reflection mirror 210 to output a scanning timing signal for instructing the timing to start scanning of the photosensitive drum 103*a*.

The photosensitive drum 103*a* is driven to rotate about the drum axis by a drum driving unit 211. The photosensitive drum 103*a* is irradiated with laser light as the spot of the laser light deflected by the rotary polygon mirror 205 being driven to rotate moves linearly in accordance with the rotation of the rotary polygon mirror 205 with the direction parallel to the drum axis as the main scanning direction. As a result, an electrostatic latent image is formed on the photosensitive drum 103*a* in the main scanning direction. The surface of the photosensitive drum 103*a* is charged by the charging device 104*a*, and the potential of the portion irradiated with the laser light changes to become an electrostatic latent image. The semiconductor laser 201 according to this embodiment is a multi-beam laser configured to emit a plurality of laser light beams. Thus, a plurality of line-like electrostatic latent images can be formed on the photosensitive drum 103*a* by one scanning operation. The photosensitive drum 103*a* is rotationally driven by the drum driving unit 211, and thus an electrostatic latent image is formed in the sub scanning direction.

The diffractive optical element 208 is a rectangular box extending in the same direction as the drum axis of the photosensitive drum 103*a*, and is rotatable about its longitudinal direction by a diffractive optical element driving unit 212. The rotation of the diffractive optical element 208 corrects the direction of the scanning line on the photosensitive drum 103*a* (inclination of the scanning line with respect to the drum axis of the photosensitive drum 103*a*) and the curvature.

The operations of the semiconductor laser 201, the rotary polygon mirror driving unit 206, the drum driving unit 211, and the diffractive optical element driving unit 212 are controlled by a central processing unit (CPU) described later.

Color Misregistration

Now, a description is given of misregistration (color misregistration) of relative positions between toner images of respective colors that are transferred from the photosensitive drums 103*a* to 103*d* onto the intermediate transfer belt 109. As described above, yellow, magenta, cyan, and black toner images are formed on the photosensitive drums 103*a* to 103*d*, respectively. The toner images of respective colors formed on the photosensitive drums 103*a* to 103*d* are transferred onto the intermediate transfer belt 109 so as to be superimposed on one another. At this time, when there is a deviation in the manner in which the toner images of respective colors are superimposed on one another, the color tones of the original image and the output image finally formed on the recording medium differ from each other, with the result that the image quality deteriorates.

The image forming apparatus 100 corrects color misregistration, for example, when the power is turned on, when the environment has changed, or when images are formed on a predetermined number (cumulative number) of recording media. The image forming apparatus 100 forms a pattern image for color misregistration detection, which is formed of the toner images of respective colors for color misregistration detection, on the intermediate transfer belt 109, and corrects color misregistration based on a result of the optical sensor 113 detecting the pattern image for color misregistration detection.

Figure 3:
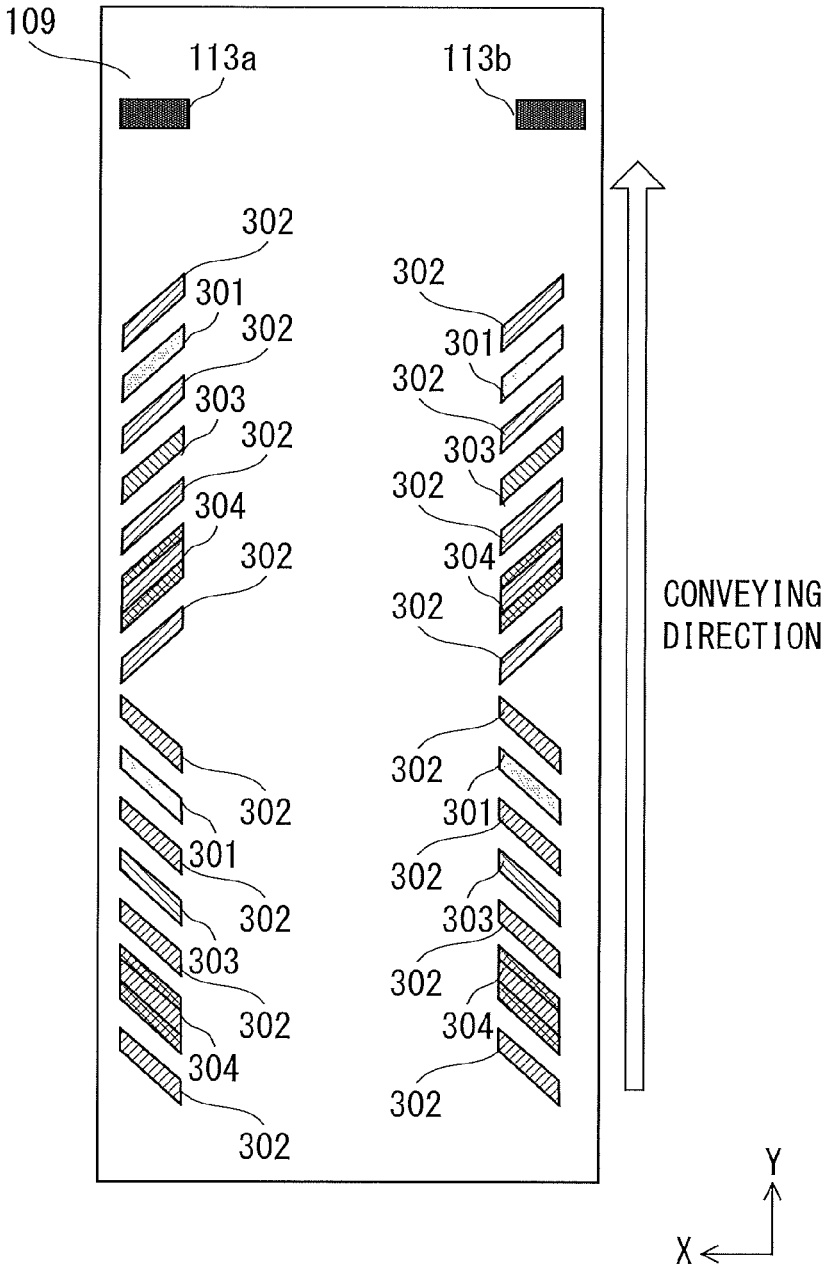
FIG. 3 is an explanatory diagram of a pattern image for color misregistration detection.

FIG. 3 is an explanatory diagram of the pattern image for color misregistration detection, which is used for correcting color misregistration. The pattern image for color misregistration detection is formed on the intermediate transfer belt 109 as illustrated in FIG. 3. The pattern image for color misregistration detection includes a yellow toner pattern 301, a magenta toner pattern 302, and a cyan toner pattern 303, which are chromatic patterns, and a composite toner pattern 304 including a black toner pattern, which is an achromatic pattern. The chromatic toner patterns 301 to 303 are measurement images used for specifying formation positions of the respective chromatic toner images. The composite toner pattern 304 is a measurement image used for specifying the formation position of the black toner image. The composite toner pattern 304 is formed, for example, by superimposing at least apart of the black toner image on the magenta toner image. The composite toner pattern 304 is described later in detail.

The conveying direction of the intermediate transfer belt 109 is the same as the rotation direction (sub-scanning direction) of the photosensitive drums 103*a* to 103*d*. The pattern image for color misregistration detection is formed at both ends of the intermediate transfer belt 109 in the main scanning direction (direction orthogonal to the conveying direction). Two optical sensors 113 are provided in correspondence to the pattern images for color misregistration detection (optical sensors 113*a* and 113*b*). When the pattern image for color misregistration detection is formed at a larger number of positions, the optical sensors 113 are provided in correspondence to the formation positions. The optical sensors 113*a* and 113*b* irradiate the intermediate transfer belt 109 with light and each output an analog signal representing a detection value (output value) corresponding to the amount of reflected light, which is the result of receiving the reflected light. The amount of light reflected by the intermediate transfer belt 109 is different between the portion where the pattern image for color misregistration detection is formed and the underlying portion of the intermediate transfer belt 109 where the pattern image for color misregistration detection is not formed. As a result, the analog signal output from the light receiving unit 602 has different values between the portion where the pattern image for color misregistration detection is formed and the underlying portion of the intermediate transfer belt 109.

In the pattern image for color misregistration detection, the magenta toner pattern 302 is formed as a reference color at a plurality of positions, and the positions of the other colors are detected as relative positions with respect to the magenta toner patterns 302. The image forming apparatus 100 calculates relative deviation amounts of respective colors from the relative positions of the toner patterns 301 to 303 of respective colors and the composite toner pattern 304, and performs color misregistration correction control based on the deviation amounts so as not to cause a deviation between the toner images of respective colors at the time of image formation.

Figure 4:
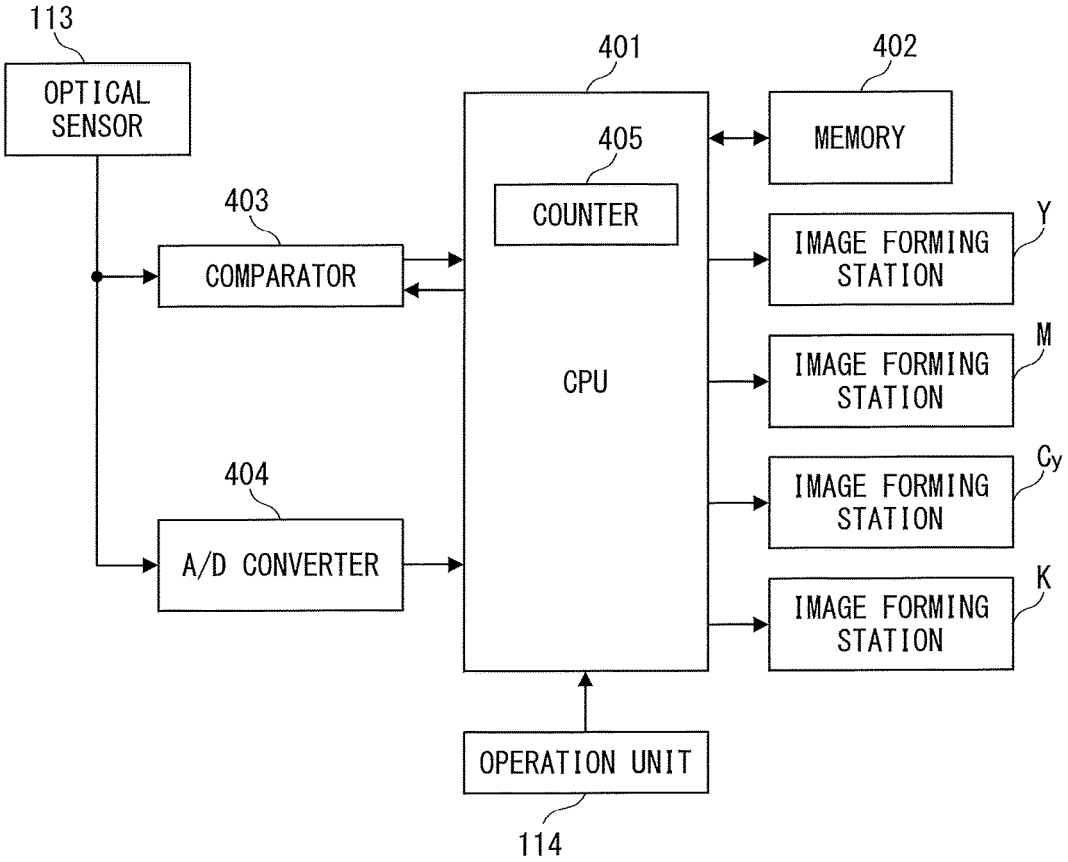
FIG. 4 is a configuration diagram of a control unit.

FIG. 4 is a configuration diagram of a control unit for controlling the operation of the image forming apparatus 100. The control unit is incorporated into the image forming apparatus 100. Now, a description is given of a configuration of the control unit for performing color misregistration correction. The control unit includes a CPU 401, a memory 402, a comparator 403, and an A/D converter 404. The CPU 401 is configured to control the operation of the image forming apparatus 100 by reading a predetermined computer program from the memory 402 for execution. In this embodiment, the CPU 401 performs color misregistration correction control by executing a computer program.

The analog signal output from the optical sensor 113 is input to the comparator 403 and the A/D converter 404. The comparator 403 converts the acquired analog signal into a binary digital signal based on a predetermined threshold value for input to the CPU 401. The threshold value for converting the analog signal into a digital signal by the comparator 403 is variable and set by the CPU 401. The A/D converter 404 converts the acquired analog signal into a digital signal for input to the CPU 401. For example, the A/D converter 404 quantizes the analog signal to generate a digital signal.

The CPU 401 includes a counter 405. The CPU 401 digitizes the digital signal acquired from the comparator 403 with the counter 405 to generate digital signal information, and stores the digital signal information in the memory 402. The CPU 401 detects the relative positions of the toner patterns 301 to 303 of respective colors and the composite toner pattern 304 based on the digital signal information. The CPU 401 calculates relative positional deviation amounts of the toner patterns 301 to 303 of respective colors and the composite toner pattern 304 based on the detection results of the relative positions, and performs color misregistration correction control based on the deviation amounts. The CPU 401 transmits a signal for correcting color misregistration to each of the image forming stations Y, M, Cy, and K. Further, the CPU 401 controls the operation of the optical sensor 113 when detecting a pattern image for color misregistration detection.

Color Misregistration Correction and Image Forming Processing

Figure 5A:
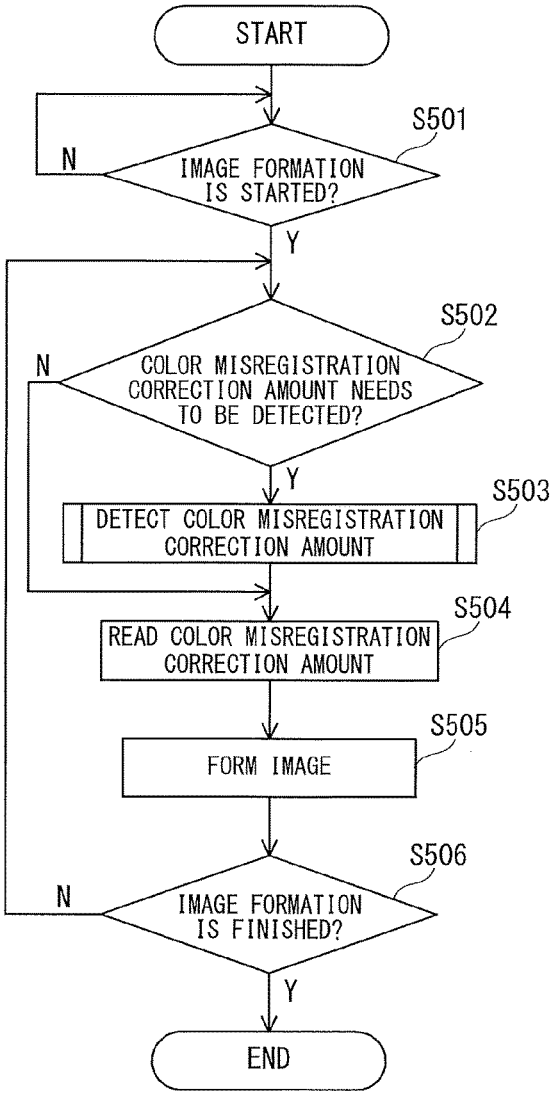
FIG. 5A and FIG. 5B are flowcharts for illustrating image forming processing.
Figure 5B:
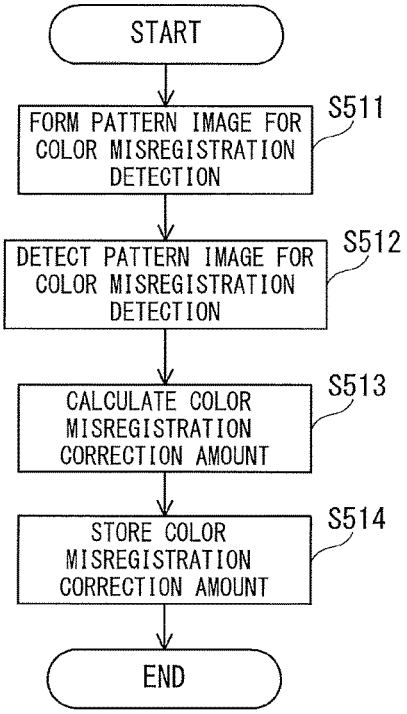

FIG. 5A and FIG. 5B are flowcharts for illustrating image forming processing including color misregistration correction control processing. FIG. 5A is a flowchart for illustrating image forming processing. As described above, the color misregistration correction control processing is performed, for example, when the power of the image forming apparatus 100 is turned on, when the environment of the image forming apparatus 100 has changed, or when images are formed on the predetermined number of recording media cumulatively.

The CPU 401 determines to start the image forming processing through an input of an image signal from the original reading unit 101 or an external device (Step S501). When the CPU 401 starts the image forming processing (Step S501: Y), the CPU 401 determines the necessity of detecting the color misregistration correction amount (Step S502). The CPU 401 determines the necessity of detecting the color misregistration correction amount depending on, for example, whether or not the power of the image forming apparatus 100 has just been turned on, images are formed on the predetermined number of recording media cumulatively, or the environment of the image forming apparatus 100, e.g., a temperature thereof, has changed from that of the previous color misregistration correction. When the CPU 401 determines that the color misregistration correction amount needs to be detected (Step S502: Y), the CPU 401 detects the color misregistration correction amount (Step S503). The CPU 401 stores the detected color misregistration correction amount in the memory 402. The color misregistration correction amount detection processing is described later.

When the color misregistration correction amount detection processing is finished, or when the color misregistration correction amount does not need to be detected (Step S502: N), the CPU 401 reads the color misregistration correction amount from the memory 402 (Step S504). The CPU 401 reads a previously calculated color misregistration correction amount or the color misregistration correction amount detected in the color misregistration correction amount detection processing, which are stored in the memory 402. The CPU 401 instructs each of the image forming stations Y, M, Cy, and K to perform image forming processing based on the color misregistration correction amount. Based on this instruction, each of the image forming stations Y, M, Cy, K adjusts the irradiation timing of the semiconductor laser 201 of each of the exposing devices 105*a* to 105*d* based on the color misregistration correction amount, to thereby form an image (Step S505).

Every time an image is formed on one recording medium, the CPU 401 determines whether the image forming processing that is based on all the acquired image signals is finished or not (Step S506). When the image forming processing is not finished (Step S506: N), the CPU 401 repeatedly executes the processing of Step S502 onward. When the image forming processing that is based on all the image signals is finished (Step S506: Y), the CPU 401 finishes the image forming processing.

FIG. 5B is a flowchart for illustrating color misregistration correction amount detection processing.

When the CPU 401 detects the color misregistration correction amount, the CPU 401 first forms a pattern image for color misregistration detection on the intermediate transfer belt 109 using the image forming stations Y, M, Cy, and K (Step S511). The pattern image for color misregistration detection is detected by the optical sensor 113. The optical sensor 113 outputs an analog signal as a detection result of the pattern image for color misregistration detection. The comparator 403 converts the analog signal output from the optical sensor 113 into a digital signal for input to the CPU 401. The CPU 401 detects a pattern image for color misregistration detection by acquiring the digital signal (Step S512). The CPU 401 calculates the color misregistration correction amount based on the acquired digital signal (Step S513). The CPU 401 stores the calculated color misregistration correction amount in the memory 402 (Step S514). The color misregistration correction amount detection processing is finished at this point.

Optical Sensor

Figure 6:
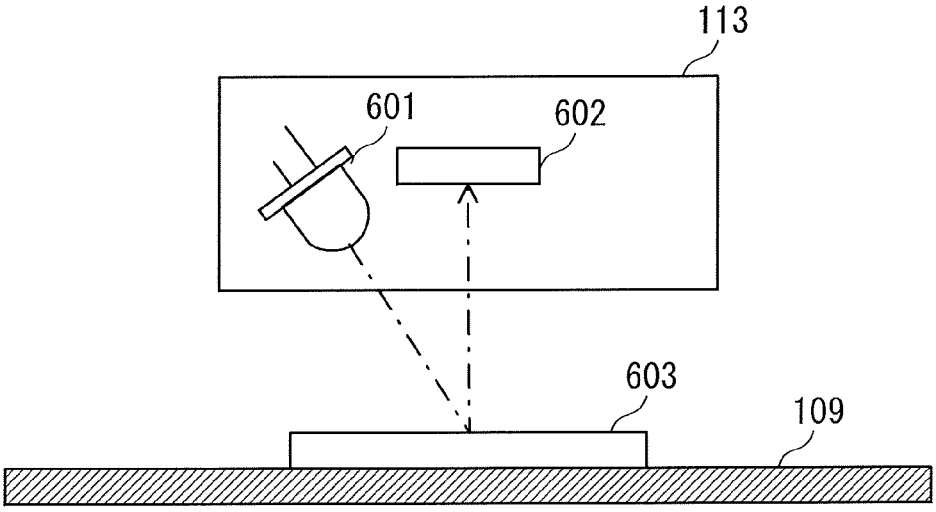
FIG. 6 is an explanatory diagram of an optical sensor.

FIG. 6 is an explanatory diagram of the optical sensor 113. The optical sensor 113 includes a light emitting unit 601 configured to irradiate the intermediate transfer belt 109 with light and a light receiving unit 602 configured to receive light reflected by the intermediate transfer belt 109. The optical sensor 113, which is configured to detect a pattern image for color misregistration detection 603, may detect regularly reflected light or irregularly reflected light (diffusely reflected light) for detection of reflected light. The optical sensor 113 according to this embodiment detects irregularly reflected light with the light receiving unit 602.

The light receiving unit 602 is placed at a position where the incident angle and the reflection angle of the light radiated from the light emitting unit 601 toward the intermediate transfer belt 109 are not equal to each other in order to receive the irregularly reflected light of the light. The light receiving unit 602 outputs an analog signal representing a detection value corresponding to the amount of reflected light, which is the result of light reception.

Conversion to Digital Signal

Figure 7:
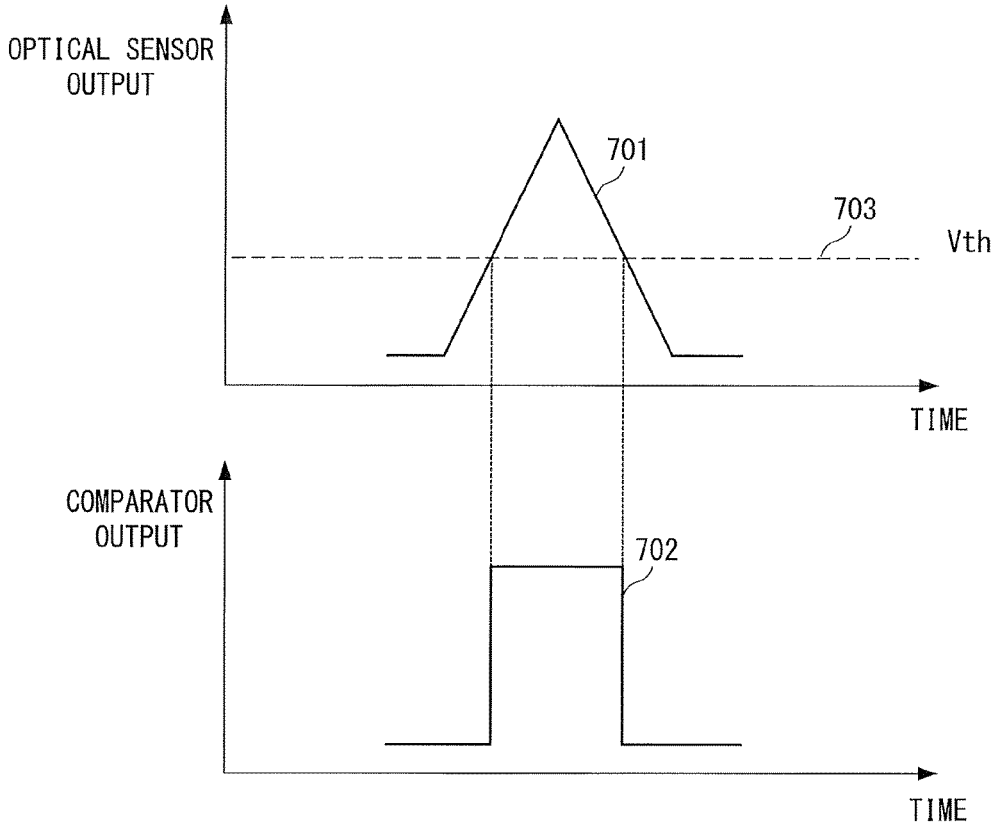
FIG. 7 is an explanatory diagram of an operation of a comparator.

FIG. 7 is an explanatory diagram of a basic operation of the comparator 403. The comparator 403 acquires an analog signal 701 from the optical sensor 113, which has detected the pattern image for color misregistration detection, and generates a digital signal 702 based on a threshold value 703.

The intermediate transfer belt 109 is glossy. Thus, the amount of light regularly reflected by the underlying portion of the intermediate transfer belt 109 is larger than the amount of light regularly reflected by the chromatic toner pattern. The amount of light emitted from the light emitting unit 601 is constant, and thus the amount of light irregularly reflected by the underlying portion of the intermediate transfer belt 109 is smaller than the amount of light irregularly reflected by the chromatic toner pattern. Therefore, the analog signal 701 obtained by detecting the chromatic toner pattern has a convex shape. In FIG. 7, the analog signal 701 is represented by a triangular wave, but the analog signal 701 is not necessarily a triangular wave. The waveform of the analog signal 701 depends on the width of a toner pattern in the conveying direction of the intermediate transfer belt 109 and the width of alight reception surface of the light receiving unit 602 of the optical sensor 113. Therefore, the waveform may have a trapezoidal-like shape depending on the relationship between those widths.

The digital signal 702 is a signal obtained by binarizing the analog signal 701 based on the threshold value 703. The comparator 403 generates the digital signal 702 by setting as a high level the analog signal 701 having a detection value that is equal to or higher than the threshold value 703, and setting as a low level the analog signal 701 having a detection value that is less than the threshold value 703.

A black toner pattern absorbs light, and thus the amount of irregularly reflected light is small. Because of this, the difference between the amount of irregularly reflected light due to the black toner pattern and the amount of irregularly reflected light due to the underlying portion of the intermediate transfer belt 109 is small, and the difference between the detection values is small. As a result, it is difficult to detect the black toner pattern using irregularly reflected light. In this embodiment, as illustrated in FIG. 3, the composite toner pattern 304 is used so that a black toner pattern can be detected easily. The CPU 401 detects the formation position of the black toner pattern based on the detection result of the composite toner pattern 304.

Composite Toner Pattern

Figure 8:
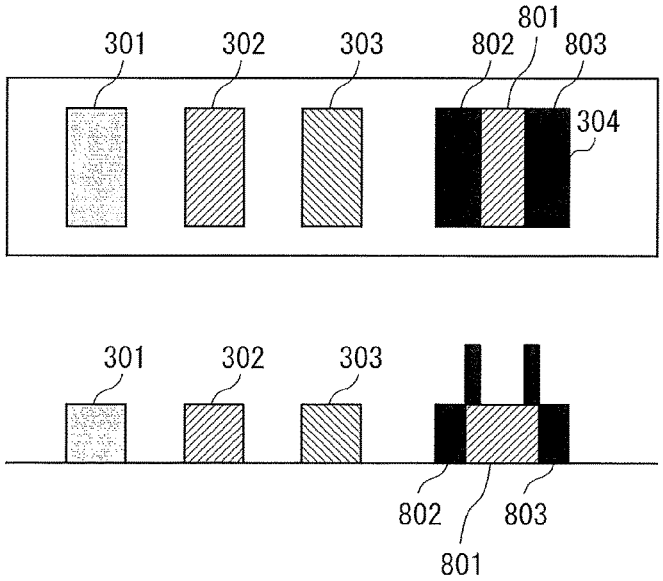
FIG. 8 is an explanatory diagram of a composite toner pattern.

FIG. 8 is an explanatory diagram of the composite toner pattern. In FIG. 8, the composite toner pattern 304 of FIG. 3 is modeled. The composite toner pattern 304 is formed by the image forming station M for forming a magenta toner image and the image forming station K for forming a black toner image.

The composite toner pattern 304 is made by forming two black toner images (second toner image 802 and third toner image 803) sandwiching a magenta toner image (first toner image 801) in the conveying direction of the intermediate transfer belt 109. The second toner image 802 and the third toner image 803 partially overlap with the first toner image 801. Further, between the second and third toner images 802 and 803, the first toner image 801 is exposed.

Figure 9:
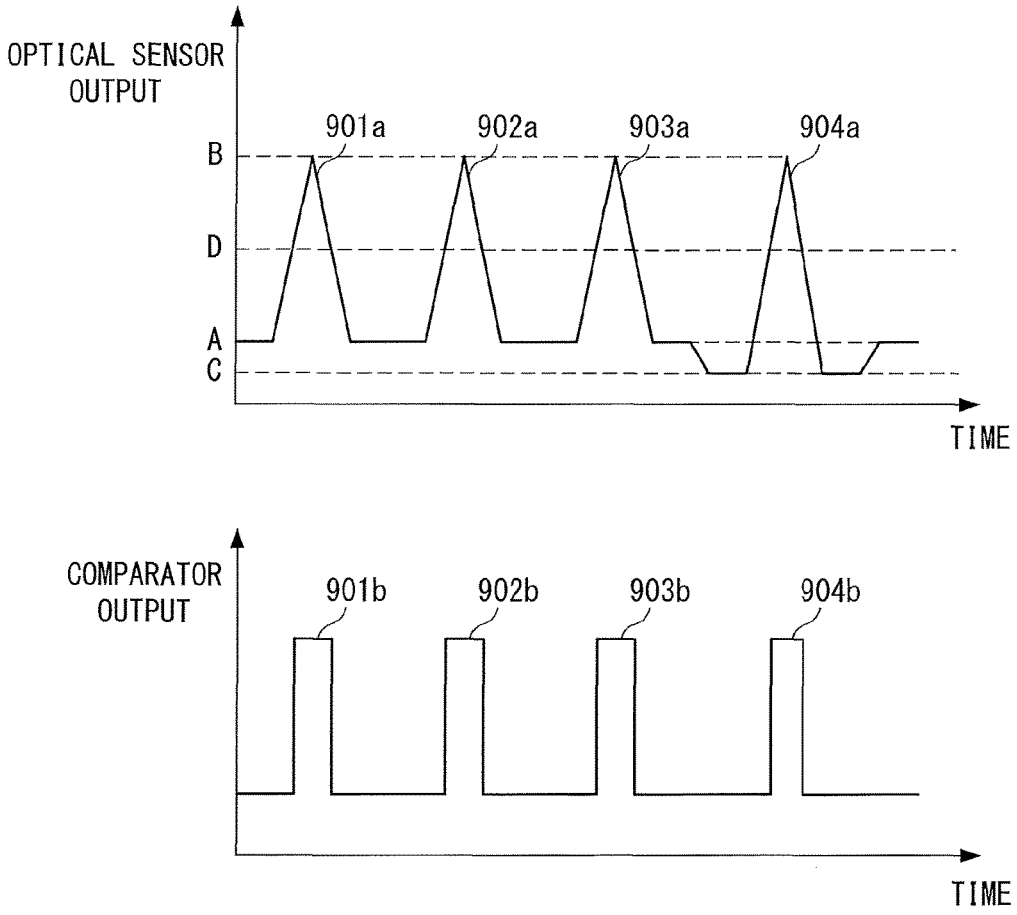
FIG. 9 is an explanatory diagram of a detection result of a pattern image for color misregistration detection of FIG. 8.

FIG. 9 is an explanatory diagram of the detection result of the pattern image for color misregistration detection of FIG. 8. The light receiving unit 602 of the optical sensor 113 outputs an analog signal having a detection value A by receiving the light irregularly reflected by the underlying portion of the intermediate transfer belt 109. In addition, the light receiving unit 602 outputs an analog signal having a detection value B by receiving the light irregularly reflected by the yellow toner pattern 301, the magenta toner pattern 302, or the cyan toner pattern 303. The detection result of the yellow toner pattern 301 is an analog signal 901*a*. The detection result of the magenta toner pattern 302 is an analog signal 902*a*. The detection result of the cyan toner pattern 303 is an analog signal 903*a*.

The detection result of the composite toner pattern 304 is as follows. The light receiving unit 602 receives light irregularly reflected by the underlying portion of the intermediate transfer belt 109, to thereby output an analog signal having the detection value A. The light receiving unit 602 receives light irregularly reflected by the second toner image 802, with the result that an analog signal to be output changes. In this embodiment, a description is given of an example in which the amount of light reflected by the second toner image 802, which is a black toner image, is smaller than the amount of light irregularly reflected by the underlying portion of the intermediate transfer belt 109. Thus, the light receiving unit 602 outputs an analog signal having a detection value C, which is lower than the detection value A, by receiving light irregularly reflected by the second toner image 802. The light receiving unit 602 outputs an analog signal having the detection value B by receiving the light irregularly reflected by the first toner image 801, which is a magenta portion of the composite toner pattern 304. After that, the light receiving unit 602 outputs an analog signal having the detection value C again by receiving light irregularly reflected by the third toner image 803 of the composite toner pattern 304.

As described above, the composite toner pattern 304 represents the formation positions of the second and third black toner images 802 and 803 based on the detection result of the first magenta toner image 801. Thus, the composite toner pattern 304 is formed such that the second toner image 802 and the third toner image 803 are formed separately from each other by a predetermined interval, and the first toner image 801 is exposed between the second and third toner images 802 and 803. The CPU 401 indirectly specifies the formation positions of the second and third black toner images 802 and 803 based on the detection result of the first magenta toner image 801.

The optical sensor 113 sequentially detects the toner patterns 301 to 303 and the composite toner pattern 304 conveyed by the intermediate transfer belt 109. In order for the optical sensor 113 to detect irregularly reflected light, the detection values of the toner patterns 301 to 303 and the composite toner pattern 304 gradually change. When detecting a pattern image for color misregistration detection as illustrated in FIG. 8, the light receiving unit 602 of the optical sensor 113 outputs analog signals whose detection values change in order of the detection value A, the detection value B, the detection value A, the detection value B, the detection value A, the detection value B, the detection value A, the detection value C, the detection value B, the detection value C, and the detection value A.

The comparator 403 converts such an analog signal into a digital signal using a threshold value D. The threshold value D is set by the CPU 401 to a value higher than the detection value A and lower than the detection value B. The converted digital signal includes outputs 901*b*, 902*b*, 903*b*, and 904*b* corresponding to the analog signals 901*a*, 902*a*, 903*a*, and 904*a*. The CPU 401 compares the difference between the center-of-gravity positions of the outputs 901*b*, 903*b*, and 904*b*, and the center-of-gravity position of the output 902*b* corresponding to the reference color (magenta in this embodiment) with a reference value stored in the memory 402. The "reference value" represents a difference between a digital signal generated by detecting the toner pattern of a reference color and a digital signal generated by detecting the toner patterns of other colors when there is no color misregistration. The CPU 401 calculates the color misregistration correction amount based on the comparison result.

Formation of Pattern Image for Color Misregistration Detection

Figure 10:
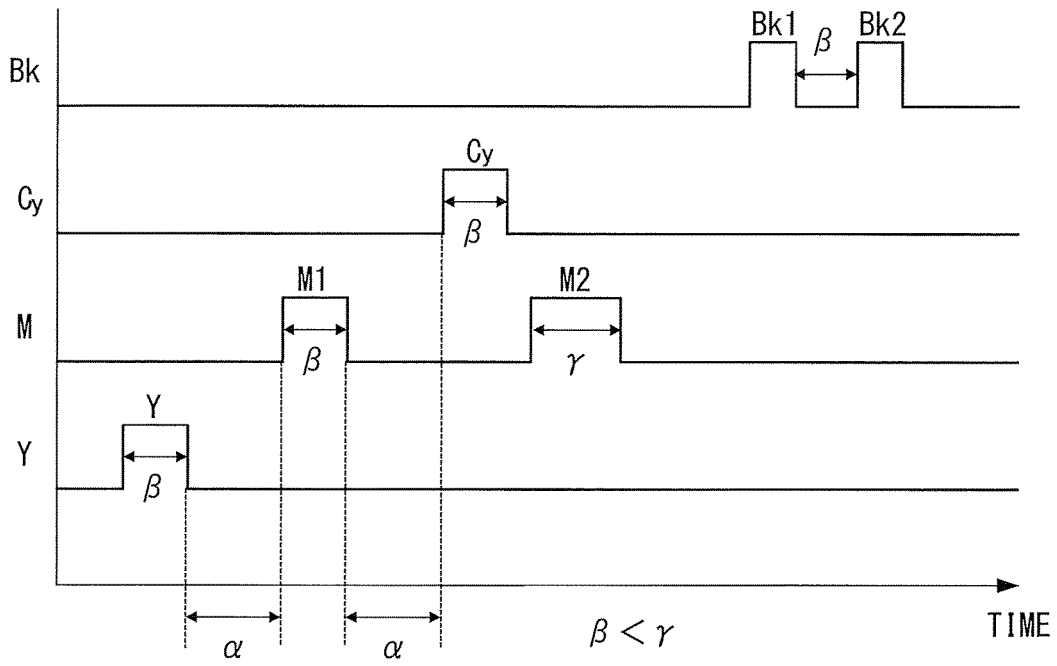
FIG. 10 is a timing chart at a time of forming the pattern image for color misregistration detection.

FIG. 10 is a timing chart at a time of forming the pattern image for color misregistration detection. Based on this timing chart, the CPU 401 causes each of the image forming stations Y, M, Cy, and K to form an image in consideration of the arrangement of the image forming stations Y, M, Cy, and K and the conveying speed of the intermediate transfer belt 109.

The CPU 401 transmits an image signal Y for forming a yellow toner pattern to the image forming station Y for yellow. The CPU 401 transmits an image signal M1 for forming a magenta toner pattern to the image forming station M for magenta after a lapse of time α from transmission of the image signal Y. The CPU 401 transmits an image signal Cy for forming a cyan toner pattern to the image forming station Cy for cyan after a lapse of time α from transmission of the image signal M1. The CPU 401 causes the image forming stations Y, M, and Cy to form images for a period of time β with the image signals Y, M, and Cy, respectively, to form toner patterns of a predetermined width corresponding to the period of time β. The yellow, magenta, and cyan toner patterns 301, 302, and 303, which are chromatic toner patterns, are formed to have the same size in the conveying direction of the intermediate transfer belt 109 due to the image signals Y, M1, and Cy. Further, the exposed area per unit area and the amount of light radiated from the exposing devices 105*a* to 105*c* of the image forming stations Y, M, and Cy are controlled such that the detection values obtained when the optical sensor 113 detects the chromatic toner patterns 301, 302, and 303 are equal to one another.

The CPU 401 continues to form the composite toner pattern 304 after forming the cyan toner pattern 303. The CPU 401 transmits an image signal M2 to the magenta image forming station M, and then transmits image signals Bk1 and Bk2 to the black image forming station B. The period of time from falling of the image signal Bk1 to rising of the image signal Bk2 is the period of time β. The CPU 401 causes the image forming station M to form an image for a period of time γ with the image signal M2, and forms a toner pattern of a predetermined width. The period of time γ is longer than the period of time β.

Black toner patterns are formed on the magenta toner pattern, which has been formed in accordance with the image signal M2, in accordance with the image signals Bk1 and Bk2. A black toner pattern corresponding to the image signal Bk1 is formed upstream of the magenta toner pattern, which has been formed in accordance with the image signal M2, in the conveying direction of the intermediate transfer belt 109. A black toner pattern corresponding to the image signal Bk2 is formed downstream of the magenta toner pattern, which has been formed in accordance with the image signal M2, in the conveying direction of the intermediate transfer belt 109. In this way, the composite toner pattern 304 is formed, which is formed of the second and third black toner images 802 and 803 overlapping with the first magenta toner image 801. The period of time from the falling of the image signal Bk1 to the rising of the image signal Bk2 is the period of time β, and thus the exposed portion of the first toner image 801 has the same size as the chromatic toner patterns 301, 302, and 303 in the conveying direction.

Underlying Toner Image

Figure 11A:
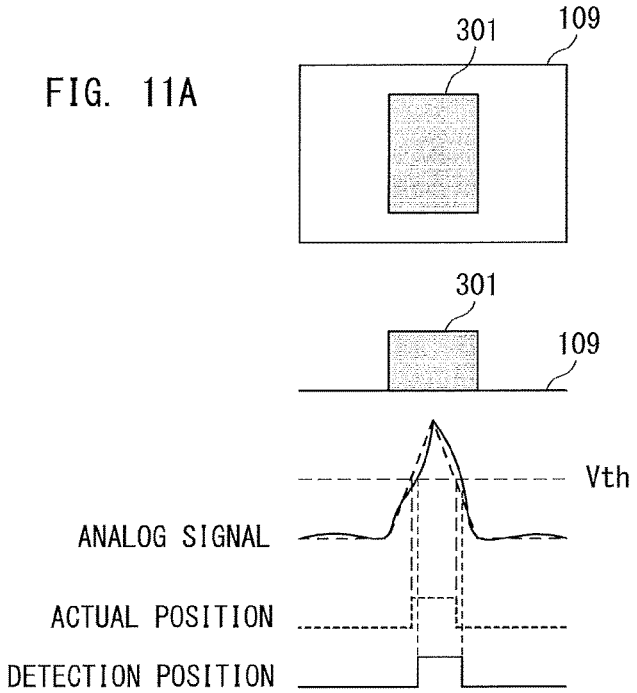
FIG. 11A and FIG. 11B are diagrams for illustrating a difference in digital signals between when an underlying toner image is formed and when an underlying toner image is not formed.
Figure 11B:
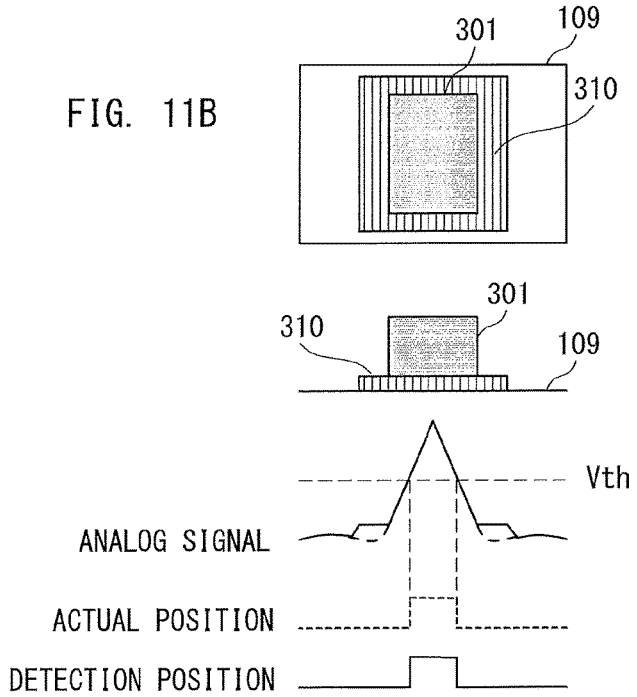

FIG. 11A and FIG. 11B are diagrams for illustrating a difference in digital signals between when an underlying toner image is formed and when an underlying toner image is not formed. The underlying toner image is a chromatic toner image that is formed as an underlying portion of the pattern image for color misregistration detection.

FIG. 11A is an explanatory diagram for illustrating a case where an underlying toner image is not formed and a yellow toner pattern 301 having a first density is formed on the intermediate transfer belt 109. The intermediate transfer belt 109 is in a state in which the reflectance varies and the amount of reflected light is not stable. In this case, the analog signal output from the optical sensor 113 has such a shape that the triangular wave is distorted as indicated by the solid line. When an analog signal having such a waveform is converted into a digital signal, the actual formation position of the toner pattern 301 cannot be detected accurately. In the example of FIG. 11A, compared to an ideal analog signal and the actual position of the toner pattern 301 indicated by the dotted lines, the analog signal and the detection position indicated by the solid lines are detected, and an accurate formation position of the toner pattern 301 cannot be grasped. Thus, in the present invention, a special pattern image is formed in order to detect the amount of color misregistration with high accuracy even under the state where the reflectance of the intermediate transfer belt 109 varies. The special pattern image is a pattern image obtained by superimposing an image for detection on a predetermined image for detection. In the following description, the predetermined image for detection is formed using a yellow toner. In the following, the predetermined yellow image for detection is referred to as an underlying toner image.

FIG. 11B is an explanatory diagram for illustrating a case where the yellow toner pattern 301 having the first density is formed on a yellow underlying toner image 310 having a second density on the intermediate transfer belt 109. The underlying toner image 310 having the second density is formed around the toner pattern 301 having the first density, and thus an influence of variation in reflectance of the intermediate transfer belt 109 is suppressed. In this case, the analog signal output from the optical sensor 113 has such a shape that the triangular wave is well formed as indicated by the solid line. As a result, it is possible to detect the formation position of the toner pattern 301 accurately. The second density is set to such a density as to suppress the influence of variation in reflectance of the intermediate transfer belt 109. The second density is preferred to be set to a density lower than the first density to reduce a toner consumption amount or avoid surpassing the cleaning capability of the image forming apparatus 100.

In this embodiment, whether or not to form an underlying toner image on the pattern image for color misregistration detection is determined based on the reflection state of the intermediate transfer belt 109 such as the reflectance of the underlying portion of the intermediate transfer belt 109 or the reflectance of the pattern image for color misregistration detection, or an instruction from the user made through the operation unit 114. In the following, a description is given of an example of determining whether or not to form an underlying toner image based on the reflectance (reflection state) of the intermediate transfer belt 109.

Figure 12A:
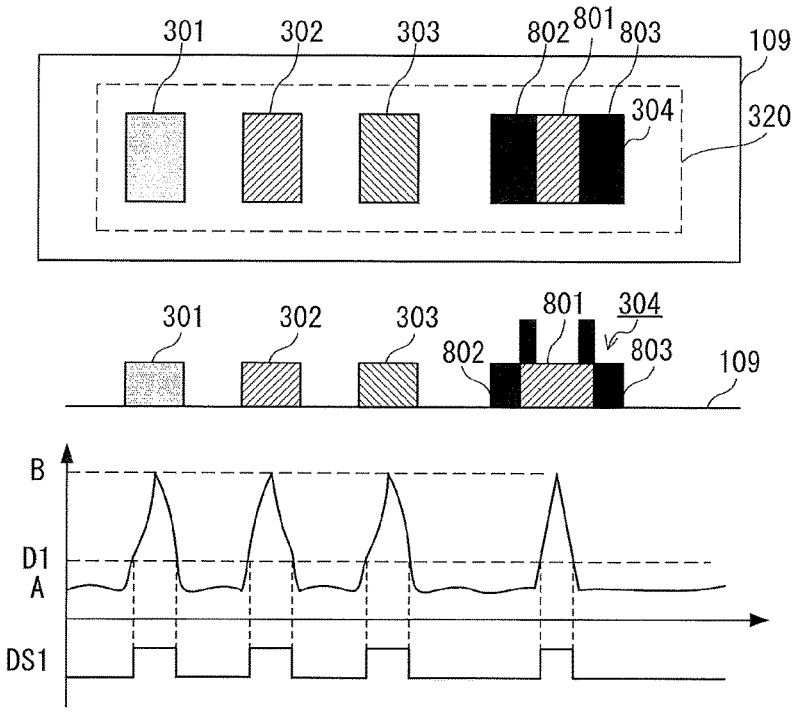
FIG. 12A and FIG. 12B are explanatory diagrams of detection results of pattern images for color misregistration detection.
Figure 12B:
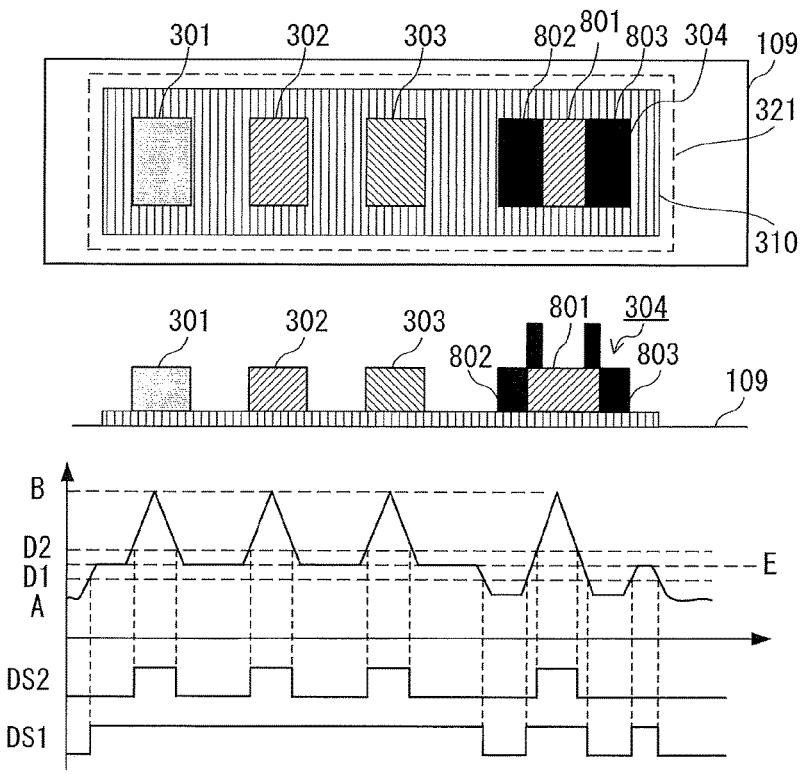

FIG. 12A and FIG. 12B are explanatory diagrams of detection results of pattern images for color misregistration detection when the reflection state of the intermediate transfer belt 109 has changed from a preferred state. FIG. 12A and FIG. 12B are illustrations of detection results of pattern images for color misregistration detection when an underlying toner image is formed or not formed.

FIG. 12A is an explanatory diagram of a case where a pattern image for color misregistration detection 320 having the first density is detected without forming an underlying toner image. The intermediate transfer belt 109 has a variation in reflectance. Thus, the analog signal output from the optical sensor 113 is not stable and its triangular wave is distorted.

A threshold value D1 for converting the analog signal obtained by detecting the pattern image for color misregistration detection 320 is determined, for example, before color misregistration detection by forming substantially the same pattern image as the pattern image for color misregistration detection 320 on the intermediate transfer belt 109 as a threshold value setting pattern. The CPU 401 calculates the threshold value D1 in accordance with the following expression based on the amounts of light irregularly reflected by the underlying portion of the intermediate transfer belt 109 and the threshold value setting pattern detected by the optical sensor 113.

$$D1=(B-A)*R+A \quad \text{(Expression 1)}$$

A: Detection value of underlying portion of intermediate transfer belt 109

B: Detection value of threshold value setting pattern

R: Ratio of wave height value, which is difference between detection value A and detection value B and is set when image forming apparatus 100 is designed The comparator 403 generates a digital signal DS1 based on a relationship between the analog signal obtained when the pattern image for color misregistration detection 320 is detected and the threshold value D1. The digital signal DS1 is input to the CPU 401. The CPU 401 detects the timings of a rising edge and a falling edge of the digital signal DS1 with the built-in counter 405. The CPU 401 calculates the amount of color misregistration using the center of the timings of the rising edge and the falling edge of the digital signal DS1 as the position of the toner pattern.

FIG. 12B is an explanatory diagram of a case where a pattern image for color misregistration detection 321 having the first density, which is formed on the yellow underlying toner image 310 having the second density, is detected. Through formation of the underlying toner image 310 on the intermediate transfer belt 109, the influence of the variation in reflectance of the intermediate transfer belt 109 is suppressed. As a result, the analog signal output from the optical sensor 113 is a stable triangular wave. When a threshold value D2 for converting the analog signal obtained by detecting the pattern image for color misregistration detection 321 is set equal to the threshold value D1, the detection value of the underlying toner image 310 may become a value higher than the threshold value D1. In this case, the analog signal cannot be converted into an accurate digital signal.

The threshold value D2 for converting the analog signal obtained by detecting the pattern image for color misregistration detection 321 is determined, for example, before color misregistration detection by forming substantially the same pattern image as the pattern image for color misregistration detection 321 on the intermediate transfer belt 109 as a threshold value setting pattern. The CPU 401 calculates the threshold value D2 in accordance with the following expression based on the amounts of light irregularly reflected by the underlying toner image 310, which is the threshold value setting pattern, and the pattern image for color misregistration detection 321 detected by the optical sensor 113.

$$D2=(B-E)*R+E \quad \text{(Expression 2)}$$

E: Detection value of underlying toner image 310

R: Ratio of wave height value, which is difference between detection value B and detection value E and is set when image forming apparatus 100 is designed The comparator 403 generates a digital signal DS2 based on a relationship between the analog signal obtained when the pattern image for color misregistration detection 321 is detected and the threshold value D2. The digital signal DS2 is input to the CPU 401. The CPU 401 detects the timings of the rising edge and the falling edge of the digital signal DS2 with the built-in counter 405. The CPU 401 calculates the amount of color misregistration using the center of the timings of the rising edge and the falling edge of the digital signal DS2 as the position of the toner pattern.

In the above description, the yellow underlying toner image 310 is formed, but another chromatic color may be used to obtain the same effect. The underlying toner image 310 is formed between the pattern image for color misregistration detection 321 and the underlying portion of the intermediate transfer belt 109 to suppress the influence of the reflectance of the intermediate transfer belt 109. Thus, it is preferred that the underlying toner image 310 be formed of a color corresponding to the image forming station that is located most upstream in the conveying direction of the intermediate transfer belt 109.

Figure 13:
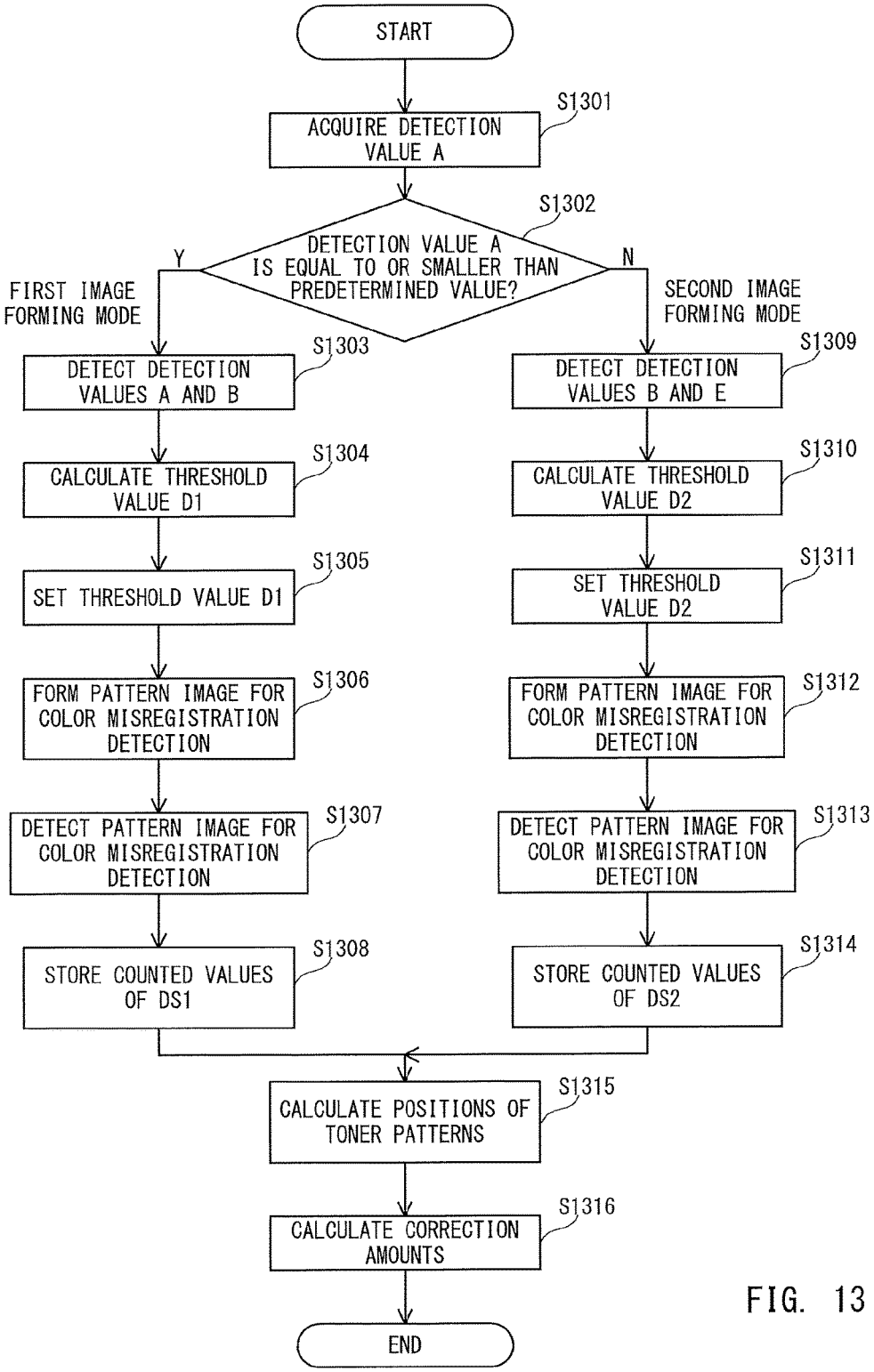
FIG. 13 is a flowchart for illustrating processing of calculating a color misregistration correction amount.

FIG. 13 is a flowchart for illustrating processing of calculating a color misregistration correction amount according to this embodiment. The CPU 401 determines whether or not to form the underlying toner image 310 depending on the degree of variation in reflectance (reflection state) of the intermediate transfer belt 109, and performs any one of two methods of calculating color misregistration correction amounts based on the determination result.

In order to determine which method to use, when the CPU 401 starts color misregistration correction, the CPU 401 acquires the detection value A of the underlying portion of the intermediate transfer belt 109 with the optical sensor 113 (Step S1301). The CPU 401 acquires the digital signal having the detection value A from the A/D converter 404, compares the detection value A with a predetermined value, and performs any one of two methods of calculating color misregistration correction amounts based on the comparison result (Step S1302). The predetermined value corresponds to a predetermined amount of light with respect to the amount of light reflected by the intermediate transfer belt 109, and is, for example, a value set in advance indicating a tolerance range of waveform distortion of the analog signal.

When the detection value A is equal to or less than the predetermined value (Step S1302: Y), the CPU 401 chooses execution of a first image forming mode. When the detection value A is not equal to or less than the predetermined value (Step S1302: N), the CPU 401 chooses execution of a second image forming mode. In this embodiment, any one of the first and second image forming modes is chosen, but a mode may be chosen from a larger number of image forming modes. The CPU 401 may determine choosing of any one of the first image forming mode and the second image forming mode based not only on the detection value A, but also on, for example, images formed on the recording medium cumulatively by the image forming apparatus 100, or settings set through the operation unit 114. When the cumulative number of sheets is smaller than the predetermined number of sheets, the CPU 401 executes the first image forming mode because the possibility that the intermediate transfer belt 109 has deteriorated is low. Further, when the cumulative number of sheets is larger than the predetermined number of sheets, the CPU 401 performs the second image forming mode because the possibility that the intermediate transfer belt 109 has deteriorated is high. In other words, the CPU 401 determines the reflection state of the intermediate transfer belt 109 based on, for example, the detection value A, the cumulative number of sheets, and the settings.

In the first image forming mode, the CPU 401 forms the same threshold value setting pattern as the pattern image for color misregistration detection 320 on the intermediate transfer belt 109. The CPU 401 detects the detection value A of the underlying portion of the intermediate transfer belt 109 and the detection value B of the pattern image for color misregistration detection 320 with the optical sensor 113 (S 1303). The CPU 401 calculates the threshold value D1 using Expression 1 described above based on the detection values A and B acquired from the A/D converter 404 (Step S1304). The CPU 401 sets the calculated threshold value D1 to the comparator 403 (Step S1305).

The CPU 401 forms the pattern image for color misregistration detection 320 without forming the underlying toner image 310 with the image forming stations Y, M, Cy, and K (Step S1306). The CPU 401 detects the pattern image for color misregistration detection 320 with the optical sensor 113 (Step S1307). The CPU 401 acquires the digital signal DS1 converted from the analog signal of the pattern image for color misregistration detection 320 with the threshold value D1 by the comparator 403. The CPU 401 stores the counted values of the timings of the rising edge and the falling edge of the digital signal DS1 counted by the counter 405 into the memory 402 (Step S1308).

In the second image forming mode, the CPU 401 forms the underlying toner image 310 and the same threshold value setting pattern as the pattern image for color misregistration detection 321 on the intermediate transfer belt 109. The CPU 401 detects the detection value E of the underlying toner image 310 and the detection value B of the pattern image for color misregistration detection 321 with the optical sensor 113 (Step S1309). The CPU 401 calculates the threshold value D2 using Expression 2 described above based on the detection values B and E acquired from the A/D converter 404 (Step S1310). The CPU 401 sets the calculated threshold value D2 to the comparator 403 (Step S1311).

The CPU 401 forms the pattern image for color misregistration detection 321 with the image forming stations Y, M, Cy, and K (Step S1312). The CPU 401 detects the pattern image for color misregistration detection 321 with the optical sensor 113 (Step S1313). The CPU 401 acquires the digital signal DS2 converted from the analog signal of the pattern image for color misregistration detection 321 with the threshold value D2 by the comparator 403. The CPU 401 stores the counted values of the timings of the rising edge and the falling edge of the digital signal DS2 counted by the counter 405 into the memory 402 (Step S1314).

The CPU 401 calculates the formation positions of the toner patterns of respective colors based on the counted values stored in the memory 402 (Step S1315). The CPU 401 calculates the relative amounts of color misregistration of the toner patterns of respective colors based on the calculated formation positions of the toner patterns of respective colors (Step S1316). The CPU 401 performs color misregistration correction in accordance with the calculated amounts of color misregistration.

The image forming apparatus 100 described above according to this embodiment appropriately sets the threshold value for detecting the formation positions of the toner patterns of respective colors of the pattern image for color misregistration detection depending on the state of the intermediate transfer belt 109. As a result, the image forming apparatus 100 can accurately grasp the formation positions of the toner patterns of respective colors, to thereby enable accurate color misregistration correction. In this manner, the image forming apparatus 100 can accurately detect the pattern image and correct the color misregistration by appropriately determining the threshold values for different image forming modes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-026733, filed Feb. 16, 2016 which is hereby incorporated by reference herein in its entirety.

What is claimed is:

1. An image forming apparatus comprising:

a plurality of image forming units configured to form images, each having a different color;

an intermediate transfer member onto which the images formed by the plurality of image forming units are transferred;

a detection unit configured to detect a detection image formed on the intermediate transfer member, the detection image being used for detecting color misregistration; and a controller configured to:

control the plurality of image forming units to form, on the intermediate transfer member, a pattern image including a plurality of detection images, each having a different color, and control the detection unit to detect an amount of color misregistration associated with a relative position of a first detection image having a reference color among the plurality of detection images and a second detection image having another color among the plurality of detection images, and to determine an adjustment value for adjusting an image write start timing of the other color different from the reference color based on the amount of color misregistration detected by the detection unit, wherein the pattern image includes the first detection image, the second detection image, and a predetermined detection image, wherein the first detection image and the second detection image are superimposed on the predetermined detection image, wherein the predetermined detection image has a color corresponding to a color of the second detection image, and wherein a density of the predetermined detection image is lower than a density of the second detection image.

2. The image forming apparatus according to claim 1, wherein the controller is further configured to:

control the plurality of image forming units to form another pattern image on the intermediate transfer member;

control the detection unit to detect an amount of another color misregistration related to a relative position between a third detection image having the reference color and a fourth detection image having the other color; and determine the adjustment value based on the amount of the other color misregistration detected by the detection unit, and wherein the third detection image and the fourth detection image are inhibited from being superimposed on the predetermined detection image.

3. The image forming apparatus according to claim 2, wherein the detection unit comprises:

a light emitting unit configured to emit light toward the intermediate transfer member;

a light receiving unit configured to receive light reflected by the intermediate transfer member and output an output value based on a reception result; and a comparator configured to compare the output value output from the light receiving unit with a threshold value, wherein the light receiving unit is configured to output the output value based on the amount of reflected light received by the light receiving unit, wherein the output value corresponding to the amount of light reflected by the intermediate transfer member is smaller than an output value corresponding to the amount of light reflected by a chromatic detection image among the plurality of detection images, wherein the controller is configured to control the plurality of image forming units to form the pattern image in a case where the output value corresponding to the amount of light reflected by the intermediate transfer member is smaller than a predetermined value, and wherein the controller is configured to control the plurality of image forming units to form the other pattern image in a case where the output value corresponding to the amount of light reflected by the intermediate transfer member is larger than the predetermined value.

4. The image forming apparatus according to claim 2, wherein the controller is configured to control the plurality of image forming units to form the pattern image in a case where a cumulative number of sheets on which the image forming apparatus has formed an output image is less than a predetermined number of sheets, and wherein the controller is configured to control the plurality of image forming units to form the other pattern image in a case where the cumulative number of sheets is greater than the predetermined number of sheets.

5. The image forming apparatus according to claim 1, wherein the detection unit comprises:

a light emitting unit configured to emit light toward the intermediate transfer member;

a light receiving unit configured to receive light reflected by the intermediate transfer member and output an output value based on a reception result; and a comparator configured to compare the output value output from the light receiving unit with a threshold value, wherein the controller is configured to determine a first threshold value for the pattern image based on a first output value corresponding to light reflected by the intermediate transfer member, and wherein the controller is configured to determine a second threshold value for another pattern image based on a second output value corresponding to light reflected by the predetermined detection image.

6. The image forming apparatus according to claim 5, wherein the light receiving unit is placed at a position where the light receiving unit avoids receiving light regularly reflected by the intermediate transfer member.

7. The image forming apparatus according to claim 1, wherein the predetermined detection image has a predetermined color other than black.

8. The image forming apparatus according to claim 1, wherein the predetermined detection image has a color different from the reference color.

9. An image forming apparatus comprising:

a plurality of image forming units configured to form images, each having a different color;

an image carrier onto which detection images formed by the plurality of image forming units are transferred;

a detection unit configured to detect the detection images transferred onto the image carrier, the detection images being used for detecting color misregistration;

a controller configured to:

perform first processing in which the image forming units form the detection images without forming a pattern image having a predetermined color, and perform second processing in which the image forming units form the detection images and the pattern image having the predetermined color, wherein the controller controls, based on detected color misregistration, a relative position of an image having a reference color among a plurality of images to be formed by the image forming units and an image having another color among the plurality of images to be formed by the image forming units, wherein the detection images are formed on the pattern image having the predetermined color in a case where the controller performs the second processing, and wherein the predetermined color is different from the reference color.

10. The image forming apparatus according to claim 9, wherein the detection unit receives reflected light from the detection images, and outputs an output value corresponding to a result of receiving the reflected light, the controller compares the output value output from the detection unit with a threshold value to detect the color misregistration, the detection unit is configured to:

compare, in a case where the controller performs the first processing, the output value with a first threshold value, and compare, in a case where the controller performs the second processing, the output value with a second threshold value, and the first threshold value is different from the second threshold value.

11. The image forming apparatus according to claim 10, wherein the controller determines the first threshold value based on a result of receiving reflected light from the image carrier and a result of receiving reflected light from the detection images, and the controller determines the second threshold value based on a result of receiving reflected light from the detection images and a result of receiving reflected light from the pattern image having the predetermined color.

12. The image forming apparatus according to claim 9, wherein the predetermined color is a color other than black.

13. The image forming apparatus according to claim 9, wherein the reference color is a color other than black.

14. The image forming apparatus according to claim 9, wherein the detection unit comprises a light emitting unit and a light receiving unit, and the light receiving unit is configured to receive irregularly reflected light from the detection images.

15. The image forming apparatus according to claim 9, wherein the image carrier conveys the detection images in a predetermined direction, and the image forming units comprise a first photosensitive member on which the pattern image having the predetermined color is formed and a second photosensitive member on which the image having the reference color is formed, the second photosensitive unit being provided downstream of the first photosensitive unit in the predetermined direction.

* * * * *